United States Patent [19]

Huang

[11] Patent Number: 4,816,623

[45] Date of Patent: Mar. 28, 1989

[54] ROTARY LINE SWITCH

[76] Inventor: Chin-Hwa Huang, 21, Nan-Ti Road, Hsi Hu Chen, Chunghwa Hsien, Taiwan

[21] Appl. No.: 129,558

[22] Filed: Dec. 7, 1987

[51] Int. Cl.[4] ..... H01H 19/14

[52] U.S. Cl. ..... 200/11 R; 200/11 TW; 200/569

[58] Field of Search ..... 200/11 R, 11 TW, 155 R, 200/156, 51.03, 298

[56] References Cited

U.S. PATENT DOCUMENTS 4,166,236 8/1979 Andrews ..... 307/146

*Primary Examiner*—A. D. Pellinen
*Assistant Examiner*—Morris Ginsburg
*Attorney, Agent, or Firm*—Varndell Legal Group

[57] ABSTRACT

An improved rotary line switch provided with an upper cover, a lower cover with trapezoid blocks and mushroom blocks on the internal walls thereof, a contact strip held by the mushroom block at one end of the lower cover, an inverted U shaped catch-contact strip having a catch end and a contact end held by the mushroom block at the other end of the lower cover, a control consisting of a knob and a lower ratchet wheel and an upper ratchet wheel each having four teeth, and a screw having a journal for the control to fit on and used to fasten the upper and lower cover together. The switch is constructed in such way that the S shaped end of a contact strip engages with a tooth of the lower ratchet wheel while the catch end of the catch-contact strip engages with a tooth of the upper ratchet wheel and serves as a catch of the same, and that when the knob is turned 90 degrees the lower ratchet wheel will push the S shaped end of the contact strip to contact with the contact end of the catch-contact strip once.

3 Claims, 3 Drawing Sheets

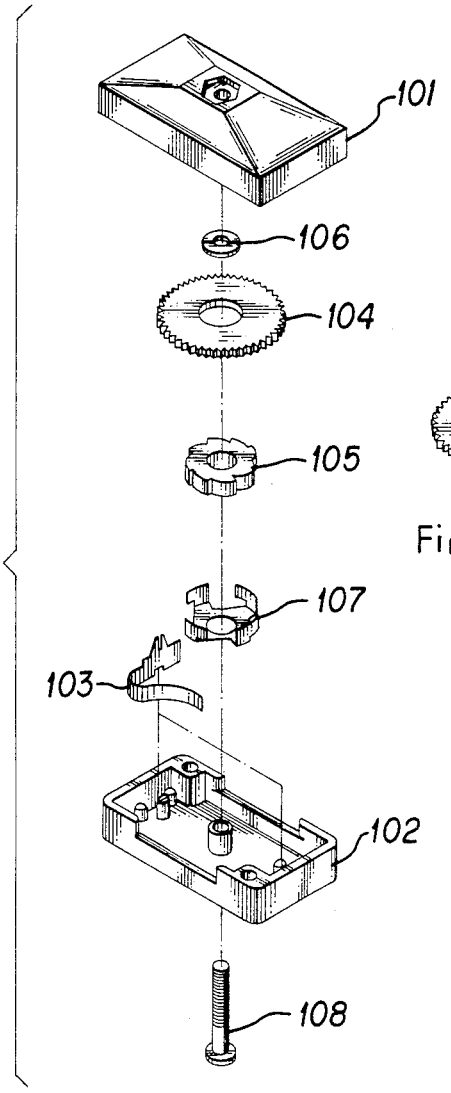
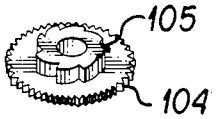
Fig. 2 PRIOR ART
Fig. 1 PRIOR ART

ROTARY LINE SWITCH

BACKGROUND AND SUMMARY OF THE INVENTION

A conventional rotary line switch, as shown in FIG. 1, comprises an upper cover 101, a lower cover 102 two contact strips 103 (only one shown) respectively fixed to the insides of both ends of the lower cover, a knob 104, a ratchet wheel 105 mounted on the knob with a bakelite washer 106 as a stop and set in between the contact strips, and a four-blade rotary connector 107 set on the ratchet-wheel to join the two contact strips indirectly. From the above, it is seen that the conventional rotary line switch is complex in construction and the knob and ratchet wheel are made individually. Idle running or poor transmission can occur when turning. The four-blade rotary connector is not only a waste of material, but also a cause of poor contact because it will shake after a certain period of use. Although a certain rotary line switches with integrally molded knob and ratchet, as shown in FIG. 2, have been developed to improve the transmission, they still employ four-blade rotary connectors. In addition, since rotary line switches which are mostly used for Christmas lamps or artist lamps are shipped with the upper cover and lower cover separated, the users must assemble them by themselves. But since the screw 108 used is a common one a journal and the stop bakelite washer must be installed, care must be taken when assembling. Otherwise the bakelite washer will be positioned incorrectly. To overcome the above-mentioned disadvantages, the present invention was developed.

A main object of this invention is to provide a rotary line switch of which the ratchet wheel and knob are integrally molded, so that no stop washer is needed and no transmission problem will occur.

Another object of this invention is to provide an improved rotary line switch which has a contact strip, a catch-contact strip and control constructed in such way that each 90 degrees rotation of the knob results in a tooth of the ratchet wheel pushing the end of the contact strip against the contact end of the catch-contact strip once.

Still another object of this invention is to provide an improved rotary line switch of which the screw has a journal which confines the control after it screws past the threaded part of the screw.

BRIEF DESCRIPTION OF THE DRAWINGS

FIG. 1 is an exploded view of the conventional rotary line switch.

FIG. 2 is a vertical view of the integrally molded ratchet wheel and knob as shown in FIG. 1.

DETAILED DESCRIPTION OF THE PREFERRED EMBODIMENT

Figure 3:
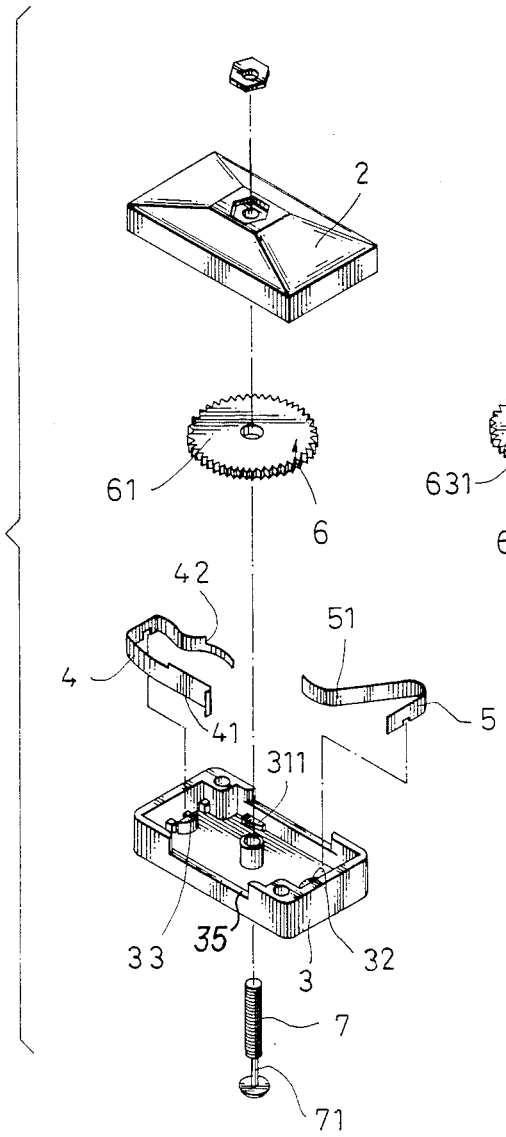
FIG. 3 is an exploded view of the improved rotary line switch of this invention.
Figure 4:
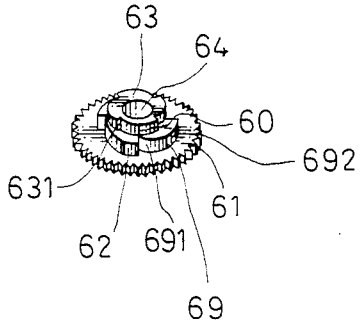
FIG. 4 is a vertical view of the improved rotary line switch as shown in FIG. 3.
Figure 5:
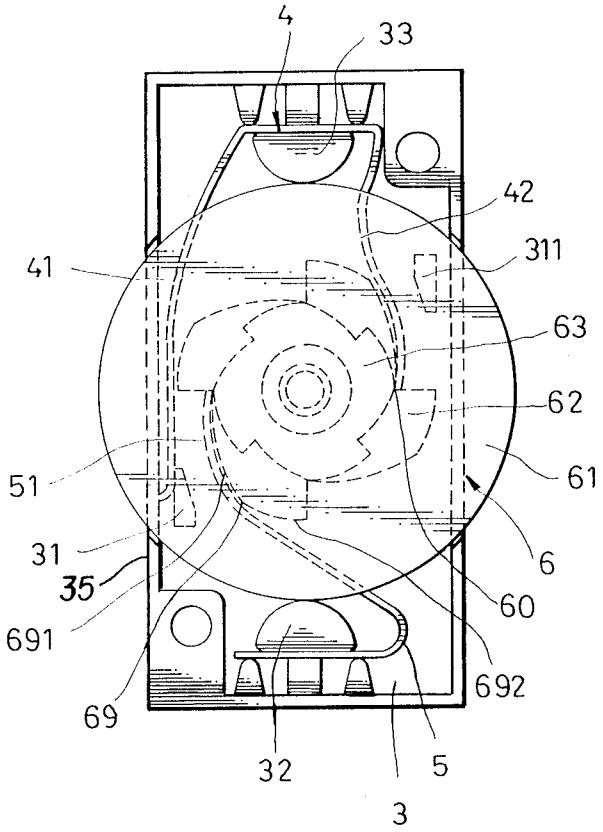
FIGS. 5 and 6 illustrate the operation of the said improved rotary line switch.
Figure 6:
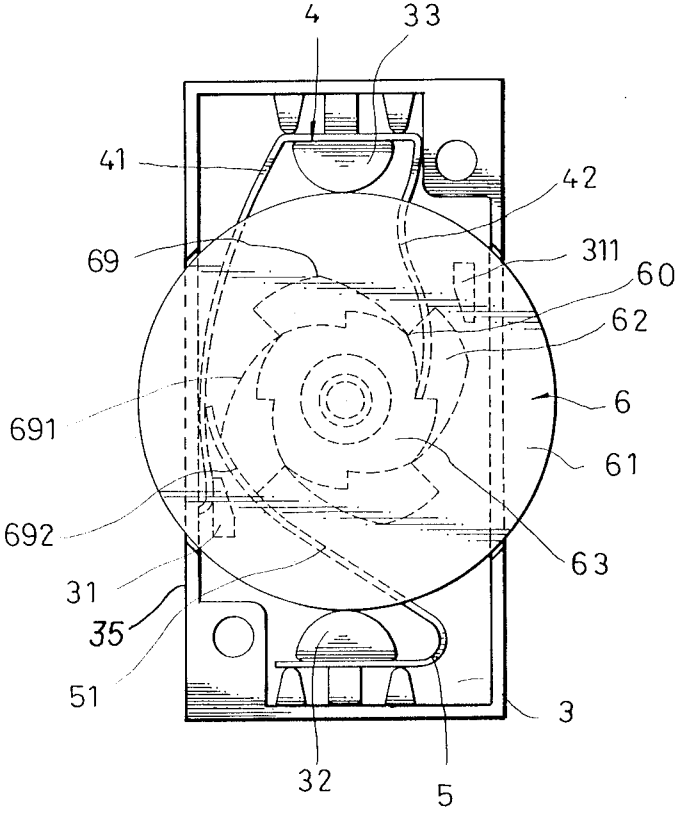

Referring now to the drawings, the nature of the present invention is described in detail as follows:

As shown in FIG. 3, the improved rotary line switch comprises an upper cover 2, a lower cover 3, a catch-contact strip 4, a contact strip 5, a control 6 and a screw 7. As shown in FIGS. 5 and 6, the lower cover 3 has two trapezoid blocks 31, 311 on its internal walls adjacent to opposite corners, and two mushroom blocks 32, 33 on the internal wall of opposite ends for holding the catch-contact strip 4 and contact strip 5 in place. FIG. 3 shows that the catch-contact strip 4 has an inverted U shape and two arms 41, 42 of different shape and size. The end of the longer arm 41 is held in between the trapezoid block 31 and the wall 35 of the lower cover 3, and the roughly S shaped arm 42 is fitted in between the trapezoid block 311 and the ratchet wheel 63. The contact strip 5 has only one S shaped arm 51 movably fitted in between the trapezoid block 31 and longer arm 41. The control 6, as shown in FIG. 4, consists of a knob 61 in diameter greater than the width of the lower cover, and two concentric ratchet wheels 62, 63 on the top side of the knob 61. The diameter of the upper ratchet wheel 63 measured from one tooth point to another is equal to that of the lower ratchet wheel 62 measured from one tooth bottom to another and the sloped teeth of the two ratchet wheels 63, 62 are interlaid in such way that the lobe point 60 of each tooth of the upper ratchet wheel 63 is located at the deepest point of the space between two teeth of the lower ratchet wheel 62. Each of the ratchet wheels 62, 63 has four inclined teeth which form four equal parts of the ratchet wheels 62, 63. Each part accounts for 90 degrees and the part from the highest point 60, 69 of the lobe to the deepest point of the space accounts for 45 degrees. The highest point 69 of each lobe divides the lobe into two curved surfaces 691, 692. The control 6 has a hole 64 in the center for a screw 7 to fix to the upper and lower covers 2, 3. The screw 7 has a journal 71 on which the control 6 is fitted after it screws past the threaded part, so that the control 6 can be pushed to turn without need of any stop washer and to prevent it from slipping off as in the conventional rotary line switch. After being assembled, the end of the contact strip 5 engages with the tooth lobe of the lower ratchet 62 while the catch arm 42 of the catch-contact strip 4 engages with the tooth lobe of the upper ratchet 63.

The operation of this improved rotary line switch is illustrated in FIGS. 5 and 6. When the knob 61 of the control 6 is turned clockwise (the catch arm 42 of the catch-contact strip 4 against one of the inclined teeth keeps it from turning backward), the lower and upper ratchet wheels 62, 63 will turn with the knob 61. At this time, the curved surface 691 of the tooth lobe of the upper ratchet wheel 62 will push the S shaped arm 51 of the contact strip 5 toward the arm 41 of the catch-contact strip 4, while the catch arm 42 of the catch-contact strip 4 moves synchronously along the tooth lobe and passes the lobe point 60 toward the tooth bottom. When it is turned 45 degrees, the curved surface 692 of the tooth lobe of the lower ratchet wheel 62 presses the contact strip 5 against the contact arm 41 of the catch-contact strip 4. At this time, the catch arm 42 of the catch-contact strip 4 stops in the tooth bottom corner of the upper ratchet wheel 63 and keeps the upper ratchet wheel 63 from turning backward which ensures good contact of the contact strip 5 and the contact arm 41 of the catch-contact strip 4, as shown in FIG. 6. When it is further turned, the contact strip 5 moves along the curved surface 692 and off the contact arm 41 of the catch-contact strip 4. When it reaches 45 degrees, the contact strip stops in the tooth bottom corner of lower ratchet wheel 62 while the catch arm 42 is pushed to the greatest extent by the tooth lobe of the upper ratchet wheel 63. Thus, each time the knob 61 is turned 90 degrees, the contact strip 5 will contact the contact arm 41 of the catch-contact strip once.

I claim:

1. An improved rotary line switch comprising an upper cover, a lower cover, a catch-contact strip, a contact strip, a control, and a screw for fastening said upper cover and said lower cover together, said lower cover having a bottom, side walls, end walls and two mushroom shaped blocks on said bottom adjacent to each end wall, said catch-contact strip having an inverted U shape and said contact strip having an S shape, said catch-contact strip and said contact strip respectively being held in place by one of said two mushroom blocks, said control being positioned between said catch-contact strip and said contact strip and having a hole therein for said screw to pass therethrough, a knob and a step ratchet wheel on an upper side of said knob, said step ratchet wheel having a lower and an upper ratchet wheel, each ratchet wheel having four inclined teeth each with a tooth lobe and a tooth bottom, said upper and lower ratchet wheels being interlaid to forms parts of 45 degrees so that when said knob is rotated 90 degrees, said catch-contact strip and said contact strip will contact one.

2. An improved rotary line switch as claimed in claim 1, wherein said lower cover has a trapezoid block on its bottom adjacent one of said side walls and one end of said catch contact strip is held therebetween, and an end of the catch-contact strip engages with one of said teeth of said upper ratchet wheel and acts as a pawl of said upper ratchet wheel.

3. An improved rotary line switch as claimed in claim 1, wherein said screw has a journal for holding said control in place and for permitting rotational movement of said control thereabout.

* * * * *